US011986715B1

(12) United States Patent
Mason et al.

(10) Patent No.: US 11,986,715 B1
(45) Date of Patent: May 21, 2024

(54) PAD USED TO SIMULATE HITTING A GOLF BALL OUT OF A SAND TRAP

(71) Applicants: Bradley R. Mason, Rancho Santa Fe, CA (US); Jeffrey T. Mason, Valley Center, CA (US)

(72) Inventors: Bradley R. Mason, Rancho Santa Fe, CA (US); Jeffrey T. Mason, Valley Center, CA (US)

( * ) Notice: Subject to any disclaimer, the term of this patent is extended or adjusted under 35 U.S.C. 154(b) by 53 days.

(21) Appl. No.: 17/978,122

(22) Filed: Oct. 31, 2022

(51) Int. Cl.
*A63B 69/36* (2006.01)

(52) U.S. Cl.
CPC ..... *A63B 69/3661* (2013.01); *A63B 2209/00* (2013.01)

(58) Field of Classification Search
CPC ..... A63B 69/3661; A63B 2209/00
See application file for complete search history.

(56) References Cited

U.S. PATENT DOCUMENTS

| | | | | |
|---|---|---|---|---|
| 6,106,409 | A * | 8/2000 | Jackson, Jr. | A63B 69/3661 473/278 |
| 8,979,663 | B1 * | 3/2015 | Breaker | A63B 69/3661 428/17 |
| 2003/0216189 | A1 * | 11/2003 | Tiffin | A63B 69/3661 473/278 |
| 2015/0087433 | A1 * | 3/2015 | Roberts | A63B 57/40 473/195 |
| 2019/0070478 | A1 * | 3/2019 | McCall | A63B 1/00 |

* cited by examiner

*Primary Examiner* — Jeffrey S Vanderveen
(74) *Attorney, Agent, or Firm* — CP LAW GROUP PC; Cy Bates

(57) ABSTRACT

A sand trap simulation pad is provided having a fluffy structure on its top surface made up of soft loose-ended hair-like fibers and having a high-friction material on its bottom surface. The pad is configured for use as a golf swing training device to practice hitting a golf ball out of a sand trap. Repetitive use of the pad teaches a user the optimal golf swing for properly hitting a golf ball out of a sand trap.

15 Claims, 3 Drawing Sheets

PAD USED TO SIMULATE HITTING A GOLF BALL OUT OF A SAND TRAP

FIELD OF THE INVENTION

The present invention relates generally to the sport of golf and more particularly to devices and methods used to improve a golf swing.

BACKGROUND

Sand traps present a unique challenge to golfers. Successfully hitting a golf ball out of a sand-filled bunker requires a different skill than hitting a golf ball on a fairway having a mown natural grass surface because inter alia sand is more readily displaceable by the club head than natural grass. Consequently, sand offers less resistance to the club head than natural grass.

Among the keys to a successful shot out of a sand trap is proper club selection. A preferred club is a specialized iron termed a sand wedge that has a relatively high degree of loft to sufficiently elevate the ball and has a favorable bounce to minimize the resistance of the sand to the club head. The golfer also modifies the impact stage of the swing when hitting out of a trap versus hitting on a fairway. During the impact stage of a fairway shot the club head typically contacts the fairway grass and the backside of the ball simultaneously with a high degree of force to propel the ball forward. In contrast, during the impact stage of a sand trap shot the club head desirably contacts the sand an inch or more behind the ball and follows an arced pathway through the sand underneath the ball without ever contacting the ball itself. By displacing the underlying sand with the club head as it follows an arced pathway through the sand, the ball is effectively propelled forward along an elevated trajectory. As a result of the different swings used in a sand trap and on a fairway, a golfer experiences a different feel when hitting a golf ball out of a sand trap as opposed to hitting a golf ball on a fairway.

It is generally necessary for golfers to repetitively practice their sand trap swing many many times to master hitting a golf ball out of a sand trap. Repetitive practice enables the golfer to identify the optimal distance behind the ball where the club head should contact the sand and enables the golfer to identify the optimal arced pathway the club head should travel through the sand beneath the ball to effect a successful shot out of the trap. Repetitive practice also enables the golfer to learn the specific feel of a successful shot out of a sand trap and develop the muscle memory of an optimal shot.

Unfortunately actual sand traps are not always available to golfers for the amount of repetitive practice required to master a proper sand trap swing. As such, the present invention recognizes the need for a device that enables a golfer to practice hitting a golf ball out of a sand trap when an actual sand trap is unavailable. Accordingly, it is an object of the present invention to provide a device that simulates a sand trap by simulating the displacement of sand with a golf club head when the head contacts the surface of the device having a regulation golf ball or practice ball lying thereon. It is further an object of the invention to provide a device that replicates the feel of a golf club hitting a ball out of sand. These objects and others are accomplished in accordance with the invention described hereafter.

SUMMARY OF THE INVENTION

The present invention is generally characterized as a sand trap simulation pad configured for use as a golf swing training device to practice hitting a golf ball out of a sand trap. Repetitive use of the pad teaches a user the optimal golf swing for properly hitting a golf ball out of a sand trap. One characterization of the sand trap simulation pad is comprised of a top layer positioned on a top side of the pad and a bottom layer positioned on a bottom side of the pad opposite the top side. The top layer has an outside face, an inside face and a fluffy structure including a multitude of fibers distributed across the outside face of the top layer. The fibers are preferably loose-ended fibers extending upwardly in a direction opposite the bottom layer to form a pile having a high pile height. A preferred pile height is on the order of about 30 mm. In addition, the fibers are preferably soft and supple and are also preferably hair-like, having a fine texture. A preferred top layer is a simulated sheepskin. In accordance with one embodiment, the fluffy structure of the top layer includes an underlying base and the fibers stand atop the underlying base.

The bottom layer is formed from a high-friction material that is preferably a rubber-like material and more preferably neoprene. The bottom layer has an outside face that is adapted to engage a pad support surface and an inside face that is positioned proximal to the inside face of the top layer.

In accordance with one embodiment, the sand trap simulation pad is further comprised of an interior layer that is less pliant than the top layer and the bottom layer. The interior layer is preferably a planar plastic sheeting fabricated from polyethylene, polypropylene, styrene or the like. The interior layer has a top inside face and a bottom inside face. The top inside face abuts the inside face of the top layer and the bottom inside face abuts the inside face of the bottom layer. The top inside face of the interior layer is preferably continuously attached to the inside face of the top layer and the bottom inside face of the interior layer is preferably continuously attached to the inside face of the bottom layer.

The sand trap simulation pad may be alternately characterized as comprising a top layer positioned on a top side of the pad, a bottom layer positioned on a bottom side of the pad opposite the top side and an interior layer positioned between the top and bottom layers that is less pliant than them. The top layer has an outside face, an inside face and a fluffy structure including a multitude of fibers distributed across the outside face of the top layer. The fibers are preferably hair-like, loose-ended fibers forming a pile having a high pile height. The bottom layer is formed from a high-friction material. The bottom layer has an inside face and an outside face that is adapted to engage a pad support surface. The interior layer has a top inside face that abuts the inside face of the top layer and a bottom inside face that abuts the inside face of the bottom layer. The top inside face is preferably continuously attached to the inside face of the top layer and the bottom inside face is preferably continuously attached to the inside face of the bottom layer.

The invention will be further understood from the accompanying drawings and description.

BRIEF DESCRIPTION OF THE DRAWINGS

The below-listed drawing figures illustrate one or more embodiments of the present invention by way of example and not by way of limitation. Common reference characters are used among the different drawing figures to indicate the same structural elements.

DETAILED DESCRIPTION OF THE INVENTION

Figure 1:
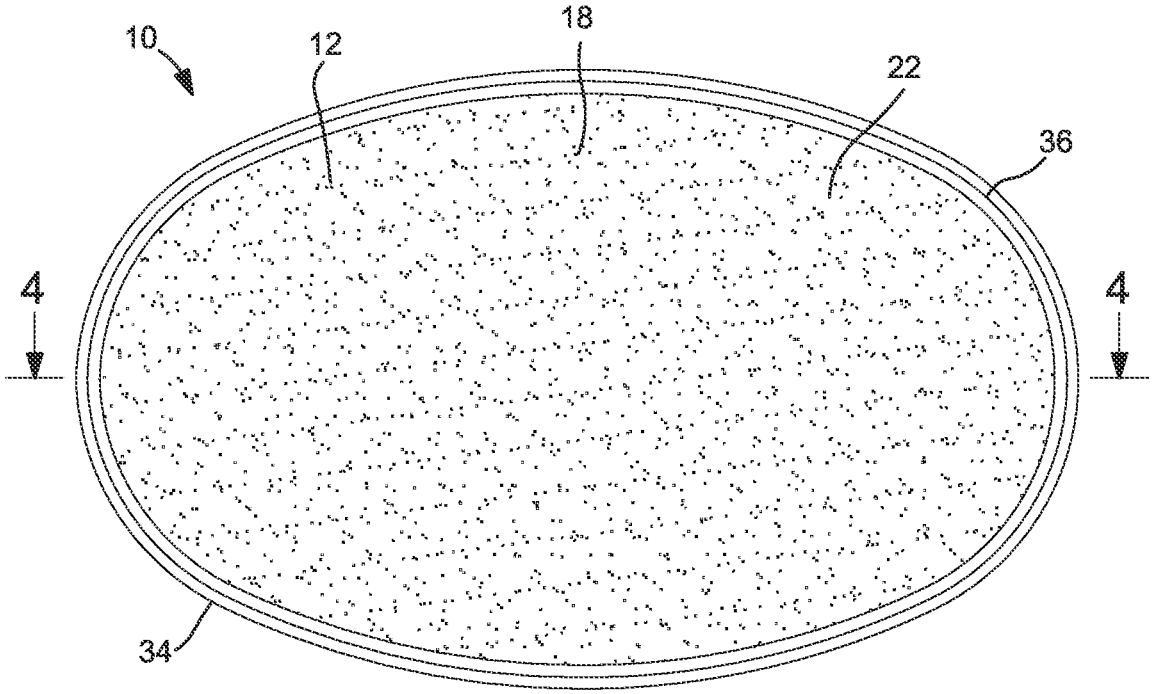
FIG. 1 is a top plan view of the sand trap simulation pad shown in FIG. 1.
Figure 2:
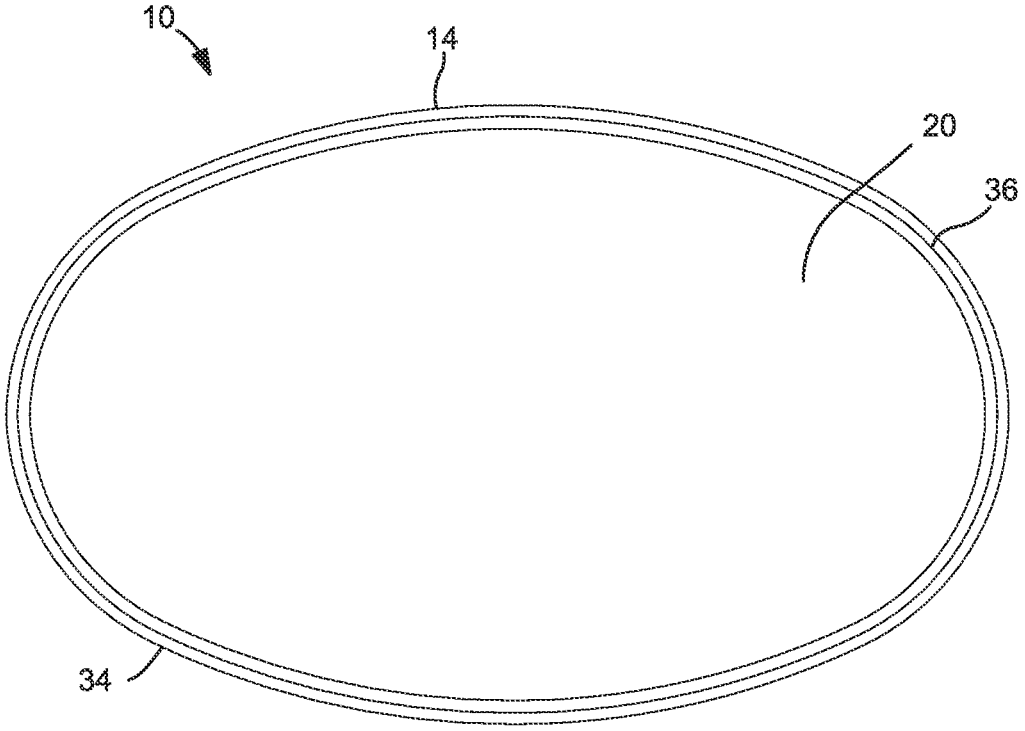
FIG. 2 is a bottom plan view of the sand trap simulation pad shown in FIG. 1.
Figure 3:
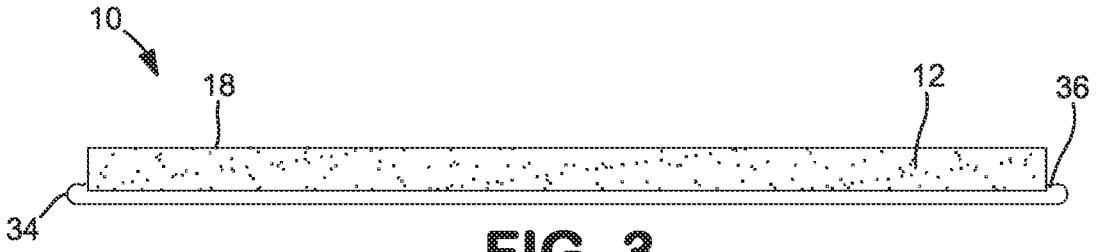
FIG. 3 is a side elevation view of the sand trap simulation pad shown in FIG. 1.
Figure 4:
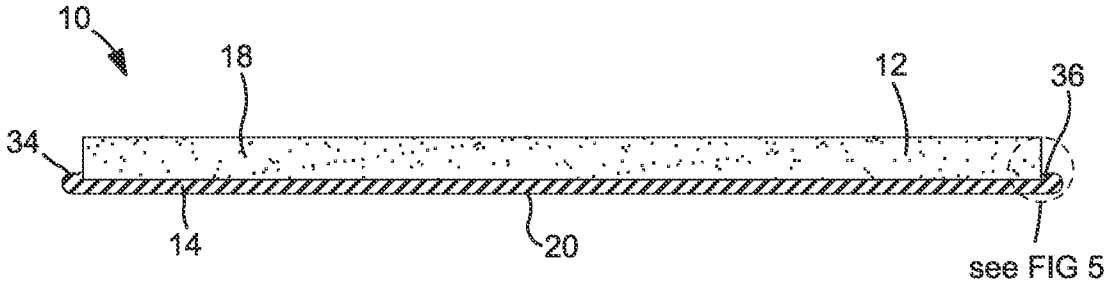
FIG. 4 is a cross section taken along line 4-4 of the sand trap simulation pad shown in FIG. 1.
Figure 5:
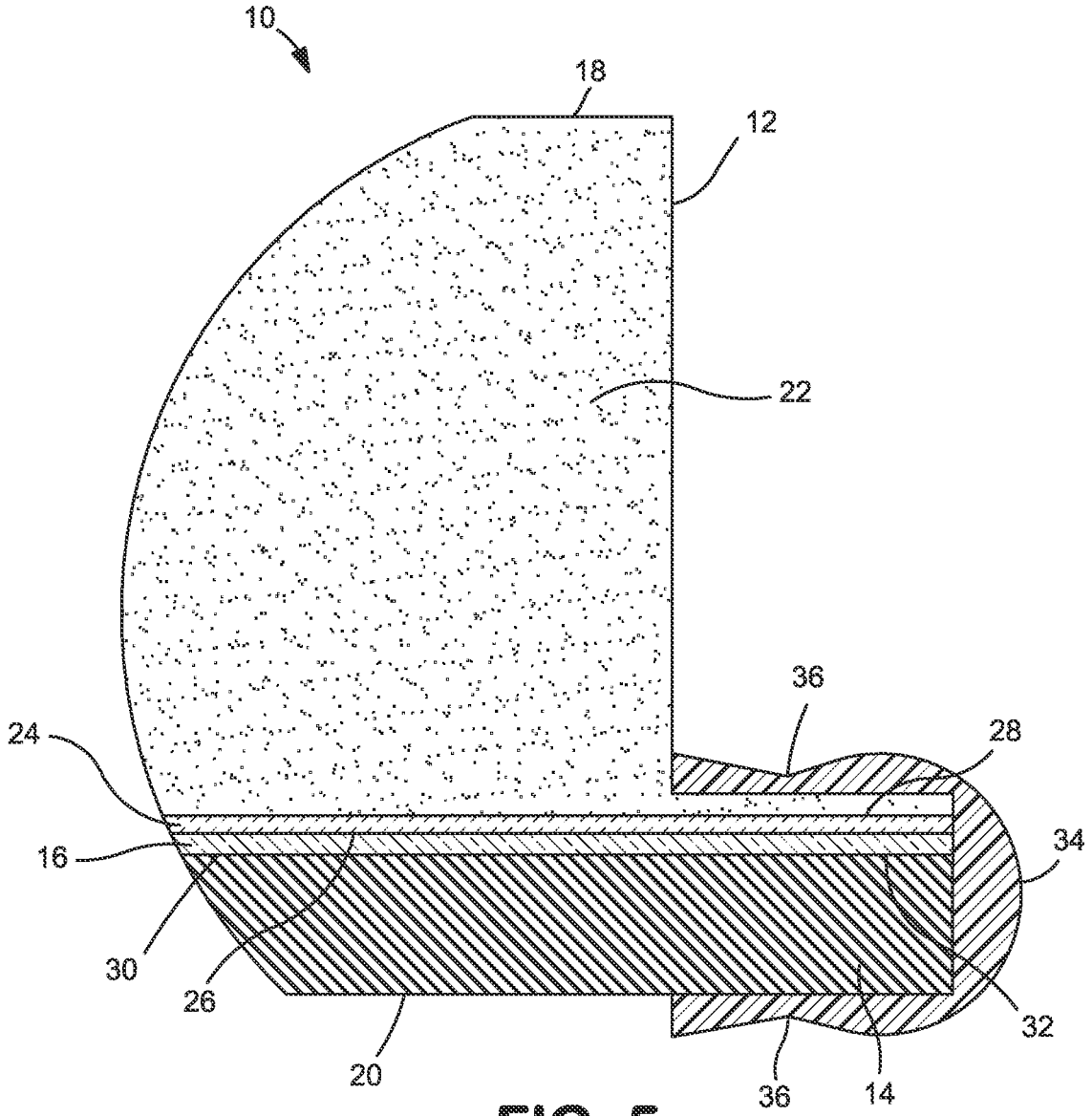
FIG. 5 is a partial blown up view of FIG. 4.

The device shown in FIGS. 1-5 and generally designated 10 is a sand trap simulation pad having a multi-layer laminate construction and a substantially planar configuration. The sand trap simulation pad 10 has a top layer 12 positioned on the top side of the pad 10 and a bottom layer 14 positioned opposite the top layer 12 on the bottom side of the pad 10. In a preferred embodiment the pad 10 also has an interior layer 16 positioned internal to the pad 10 between the top and the bottom layers 12, 14. The top layer 12 has an exposed outside face which is one and the same as the top outside face of the pad 10. As such, both are designated by the same reference number 18. The bottom layer 14 similarly has an exposed outside face which is one and the same as the bottom outside face of the pad 10 and both are designated by the same reference number 20. The terms "top" and "bottom" are used herein with reference to the orientation of the sand trap simulation pad 10 during use. Top structural elements of the pad 10 are vertically positioned above bottom structural elements of the pad 10. As such, bottom structural elements are positioned more proximal than top structural elements to a support surface (not shown) bearing the sand trap simulation pad 10 during use. Thus, for example, the top layer 12 is positioned above the bottom layer 14 on the pad 10, while the bottom layer 14 is positioned more proximal than the top layer 12 to the support surface. The terms "inside" and "outside" are used herein with reference to the exterior of the pad 10. Outside faces of the pad 10 are exposed to the exterior of the pad 10, while inside faces are not, but are instead directed to the interior of the pad 10.

The top layer 12 is a pliant unitary fluffy structure having the configuration of a substantially continuous planar sheet. The fluffy structure forming the top layer 12 is comprised of a multitude of soft supple hair-like fibers 22 preferably having a fine texture. Thus, for example, the fibers 22 are preferably softer, suppler, finer and longer than the coarser bristle-like fibers or imitation grass blades that are typically used in conventional outdoor door mats and golf driving range mats. The fluffy structure of the top layer 12 is further comprised of a thin backing 24 underlying the fibers 22. The fibers 22 stand on end atop the backing 24 and merge with the backing 24 by conventional means such as weaving, knitting, tufting or the like. The free-standing ends of the fibers 22 extend upwardly away from the backing 24 in a direction opposite the bottom layer 14. The loose-ended fibers 22 are uniformly distributed across the top layer 12 in a densely-populated pile having a relatively high pile height, i.e., the distance the fibers 22 extend upward away from the backing 24 when not subjected to any compression forces. The pile height is preferably at least about 15 mm and is more preferably on the order of about 30 mm. It is apparent that the term "fluffy structure" as used herein with reference to the top layer 12 encompasses a variety of fibrous structures having a high pile height and density including inter alia pile, napped and tufted fabrics. A preferred fluffy structure is a synthetic such as faux fur, fleece, plush, shag carpet or the like. A particularly preferred fluffy structure is a simulated sheepskin having a dense high-loft pile. Some simulated sheepskins are characterized as having a coarse texture while others are characterized as having a fine texture. A still more particularly preferred fluffy structure is a simulated lambskin which is a type of sheepskin having a fine structure.

The bottom layer 14 and interior layer 16 are both characterized as substantially continuous homogeneous planar sheets. The bottom layer 14 is preferably a homogeneous sheet of pliant high-friction material such as a rubber-like material, e.g., rubber, synthetic rubber and the like. A particularly preferred material is a neoprene sheet having a thickness on the order of about 5 mm. The interior layer 16 has a top inside face 26 that engages the inside face 28 of the top layer 12 and a bottom inside face 30 that engages the inside face 32 of the bottom layer 14. The interior layer 16 is preferably at least somewhat pliant, but is preferably stiffer and less pliant than the top or bottom layers 12, 14. As such, the interior layer 16 renders the pad 10 resistant to bunching caused by billowing of the pad 10 when engaged by the bottom edge of a club head during swing practice. A preferred material of construction for the interior layer 16 is planar plastic sheeting fabricated from polyethylene, polypropylene, styrene or the like and having a thickness on the order of about 0.5 mm. An alternate material of construction is a thick sheet of paper, cardboard or the like.

In accordance with a preferred embodiment, the inside face 28 of the top layer 12 and the top inside face 26 of the interior layer 16 are substantially permanently continuously attached to one another along their plane of intersection preferably by conventional means such as an adhesive (e.g., glue) or the like. The inside face 32 of the bottom layer 14 and the bottom inside face 30 of the interior layer 16 are similarly substantially permanently continuously attached to one another along their plane of intersection. When the layers 12, 14, 16 are continuously joined together in this manner, the entire pad 10 has a unitary integrated structure.

The perimeter of the pad 10 preferably has a rounded configuration and more preferably has an oval shape that is about 24 inches along its length axis and is about 14 inches along its width axis. A continuous binding 34 is desirably provided around the perimeter of the pad 10 to prevent separation of the layers 12, 14, 16 from one another along their edges. The binding 34 is preferably a continuous narrow strip of durable pliant material that encloses the layers 12, 14, 16 along the perimeter of the pad 10. The binding 34 is machine sewn directly onto the layers 12, 14, 16, thereby forming a seam 36 that compresses the top layer 12. Vinyl is an exemplary material for the binding 34.

USE OF SAND TRAP SIMULATION PAD

The sand trap simulation pad 10 is positioned for use by placing the pad 10 on a support surface with the bottom layer 14 down so that the bottom outside face 20 engages the support surface and top layer 12 up so that the top outside face 18 is fully exposed. The support surface is preferably flat and relatively smooth. Exemplary indoor support surfaces having utility herein include hard flooring, carpeted flooring and artificial turf-covered flooring. Exemplary outdoor support surfaces having utility herein include close-cropped grass and artificial turf. The pad 10 is preferably positioned with the longer length axis of the pad 10 aligned with the direction of the shot while the shorter width axis is aligned perpendicular to the direction of the shot.

Use is initiated by placing a golf ball on the top outside face 18 of the pad 10 while the pad 10 rests on the support surface. The ball is preferably positioned at or near the center of the top outside face 18. The golf ball may be a regulation golf ball or a practice golf ball. Practice golf balls are the same size as regulation golf balls, but are typically much more light-weight than regulation golf balls. Practice golf balls are often constructed from a foam and resemble Nerf balls. NERF is a registered trademark of Hasbro, Inc., 1027 Newport Avenue, Pawtucket, Rhode Island 02862. Alternatively, practice golf balls are constructed from a relatively rigid plastic, but are hollow with holes in the outside surface, thereby resembling Wiffle balls. WIFFLE is a registered trademark of Wiffle Ball, Inc., 275 Bridgeport Ave., Shelton, Connecticut 06484. Practice golf balls are typically preferred over regulation golf balls for indoor use because practice balls do not travel as far when hit and are easier to retrieve. Practice golf balls are also less likely to damage indoor furnishings should they strike any due to their light weight.

The user selects a desired golf club for hitting out of a sand trap. With the club in hand, the user stands on the support surface adjacent to the pad 10 facing the ball and feet aligned parallel to the length axis of the pad 10 in a normal sand trap shot stance and posture to address the ball. It is noted that the pad 10 is sized solely to accommodate the golf ball and is not sized to accommodate the user's feet. The user then performs a sand trap shot in multiple sequential stages, namely, a takeaway, downswing, impact and follow-through stage. At the bottom of the downswing the club head and specifically the lower face and bottom leading edge of the club head engage the top outside face 18 of the pad 10 at a relatively steep downward angle slightly behind the ball, thereby initiating the impact stage. The bottom of the club head penetrates the loose-ended fibers 22 of the pad 10 behind the ball and follows an arced pathway through the fibers 22 as if hitting out of a sand trap.

If the club head contacts the pad 10 too far behind the ball or too close to the ball and/or the club head does not follow a proper pathway through the fibers 22, the resulting path that the ball travels will indicate to the user that the shot has failed and that correction of the swing is required. Another indicator of a failed shot due to an improper club head contact point on the pad 10 or pathway through the fibers 22 is if the club head moves the pad 10 more than about 4 inches forward on the support surface upon impact. In view of the foregoing it is apparent that repetitive swing training using the sand trap simulation pad 10 will teach the user the optimal distance behind the ball where the club head should contact the sand and the optimal arced pathway the club head should travel through the sand to effect a successful sand trap shot and will ultimately teach the user the overall feel of properly hitting a golf ball out of a sand trap.

While the forgoing preferred embodiments of the invention have been described and shown herein, it is understood that alternatives and modifications, such as those suggested and others, may be made thereto and fall within the scope of the invention. For example, although preferred materials of construction for the pad have been disclosed above, it is readily apparent to one of ordinary skill in the art applying the teaching herein that it is alternatively within the scope of the present invention use alternate materials of construction for the pad to achieve the same objectives.

We claim:

1. A sand trap simulation pad comprising:

a top layer positioned on a top side of said pad and having an outside face and an inside face, wherein said top layer has a fluffy structure including a multitude of fibers distributed across said outside face of said top layer;

a bottom layer positioned on a bottom side of said pad opposite said top side, having an outside face and an inside face and formed from a high-friction material, wherein said outside face of said bottom layer is adapted to engage a pad support surface and said inside face of said bottom layer is positioned proximal to said inside face of said top layer; and an interior layer having a top inside face and a bottom inside face, wherein said top inside face abuts said inside face of said top layer and said bottom inside face abuts said inside face of said bottom layer, wherein said interior layer is planar plastic sheeting.

2. The sand trap simulation pad of claim 1, wherein said interior layer is less pliant than said top layer and said bottom layer.

3. The sand trap simulation pad of claim 1, wherein said interior layer is fabricated from polyethylene, polypropylene or styrene.

4. The sand trap simulation pad of claim 1, wherein said top inside face is continuously attached to said inside face of said top layer and said bottom inside face is continuously attached to said inside face of said bottom layer.

5. The sand trap simulation pad of claim 1, wherein said high-friction material is neoprene.

6. The sand trap simulation pad of claim 1, wherein said top layer is a simulated sheepskin.

7. The sand trap simulation pad of claim 1, wherein said fluffy structure includes an underlying base and said fibers stand atop said underlying base as loose-ended fibers extending upwardly away in a direction opposite said bottom layer.

8. A sand trap simulation pad comprising:

a top layer positioned on a top side of said pad and having an outside face and an inside face, wherein said top layer has a fluffy structure including a multitude of fibers distributed across said outside face of said top layer;

a bottom layer positioned on a bottom side of said pad opposite said top side, having an outside face and an inside face and formed from a high-friction material, wherein said outside face of said bottom layer is adapted to engage a pad support surface; and an interior layer less pliant than said top layer and said bottom layer and having a top inside face and a bottom inside face, wherein said top inside face abuts said inside face of said top layer and said bottom inside face abuts said inside face of said bottom layer, wherein said interior layer is planar plastic sheeting.

9. The sand trap simulation pad of claim 8, wherein said top inside face is continuously attached to said inside face of said top layer and said bottom inside face is continuously attached to said inside face of said bottom layer.

10. The sand trap simulation pad of claim 8, wherein said interior layer is fabricated from polyethylene, polypropylene or styrene.

11. The sand trap simulation pad of claim 8, wherein said top layer is a simulated sheepskin.

12. A sand trap simulation pad comprising:

a top layer positioned on a top side of said pad and having an outside face and an inside face, wherein said top layer has a fluffy structure including a multitude of fine-textured, loose-ended, hair-like fibers distributed across said outside face of said top layer and forming a pile having a high pile height;

a bottom layer positioned on a bottom side of said pad opposite said top side, having an outside face and an inside face and formed from a high-friction material, wherein said outside face of said bottom layer is adapted to engage a pad support surface and said inside face of said bottom layer is positioned proximal to said inside face of said top layer; and an interior layer less pliant than said top layer and said bottom layer and having a top inside face and a bottom inside face, wherein said top inside face abuts said inside face of said top layer and said bottom inside face abuts said inside face of said bottom layer, wherein said interior layer is planar plastic sheeting.

13. The sand trap simulation pad of claim 12, wherein said fluffy structure includes an underlying base and said fibers stand atop said underlying base extending upwardly away in a direction opposite said bottom layer.

14. The sand trap simulation pad of claim 12, wherein said interior layer is fabricated from polyethylene, polypropylene or styrene.

15. The sand trap simulation pad of claim 12, wherein said top layer is a simulated sheepskin.

* * * * *